US006131326A

United States Patent [19]

Case

[11] Patent Number: 6,131,326

[45] Date of Patent: Oct. 17, 2000

[54] MUZZLE LOADED FIREARM SAFETY DEVICE

[76] Inventor: Geoffrey Case, 10065 Alcosta Blvd., San Ramon, Calif. 94583

[21] Appl. No.: 09/294,887

[22] Filed: Apr. 19, 1999

Related U.S. Application Data

[63] Continuation-in-part of application No. 08/963,609, Oct. 31, 1997, abandoned.

[51] Int. Cl.[7] ..... F41A 35/04; F41A 17/00

[52] U.S. Cl. ..... 42/96; 42/70.01

[58] Field of Search ..... 42/96, 70.01, 95

[56] References Cited

U.S. PATENT DOCUMENTS

| | | | |
|---|---|---|---|
| 268,004 | 11/1882 | Davis | 401/9 |
| 1,229,991 | 6/1917 | McGavisk | 42/96 |
| 2,405,308 | 8/1946 | Jack | 434/19 |
| 2,544,150 | 3/1951 | Franklin | 15/104.16 |
| 2,836,918 | 6/1958 | Pula et al. | 42/70.11 |
| 3,027,674 | 4/1962 | Mahan | 42/66 |
| 3,371,440 | 3/1968 | Cassell | 42/49.02 |
| 3,564,746 | 2/1971 | McConnell | 42/96 |
| 3,813,802 | 6/1974 | Prospero | 42/96 |
| 4,100,693 | 7/1978 | Cech | 42/96 |
| 4,455,777 | 6/1984 | Callies | 42/59 |
| 4,969,284 | 11/1990 | Healey et al. | 42/70.11 |
| 5,628,136 | 5/1997 | Wickser, Jr. | 42/95 |

FOREIGN PATENT DOCUMENTS

| | | | |
|---|---|---|---|
| 272596 | 4/1914 | Germany | 42/95 |
| 4024541 | 2/1992 | Germany | 42/95 |
| 362 | 2/1862 | United Kingdom | 42/96 |

OTHER PUBLICATIONS

Shooter's Bible. Snap Caps. 1963 Ed. p. 112, copyright 1962.

The American Rifleman. Reconditioning Snap Caps. Nov. 1973, p. 72.

*Primary Examiner*—Michael J. Carone
*Assistant Examiner*—Son T. Nguyen

[57] ABSTRACT

A muzzle loaded firearm safety device for relieving the tension in a hammer spring of a weapon prior to storage without dry-firing the weapon and causing damage to the weapon's firing pin. The device comprises a jacket having an enclosed jacket top with an outward-extending threaded cylinder, and a partially enclosed jacket bottom having an aperture. An impact piston is slidably secured within the jacket, biased against the jacket bottom by a coil spring. A standard gun cleaning rod is secured to the threaded cylinder, and the entire jacket assembly is secured to the threaded cylinder, the entire jacket assembly is inserted into the muzzle and down the barrel of a shotgun, until abutting the weapon's firing chamber wall. By depressing the trigger of the weapon, the hammer spring extends, forcing the hammer into the firing pin which in turn contacts the impact piston, moving the impact piston forward against the biasing coil spring without causing damage to the firing pin. The jacket may then be withdrawn from the barrel, and the shotgun stored with the hammer spring in a relaxed state.

1 Claim, 3 Drawing Sheets

MUZZLE LOADED FIREARM SAFETY DEVICE

RELATED APPLICATION

This application is a continuation-in-part of co-pending application Ser. No. 08/963,609 filed Oct. 31, 1997 abandoned.

BACKGROUND OF THE INVENTION

1. Field of the Invention

The invention relates to a firearm safety device. More particularly, the invention relates to a muzzle-loaded device which prevents the dry firing of a firearm by absorbing the tension which is stored in the hammer spring of the weapon.

2. Description of the Prior Art

Owners of shotguns, rifles pistols and associated firearms are often presented with a potential problem known as "dry-firing" when storing their weapons.

Typically, a firearm such as a shotgun which is stored subsequent to use is left in a "ready-to-fire" mode in that the hammer spring of the hammer is tensioned, poised to cause the hammer to strike the firing pin of the weapon. To simply store the weapon in this fashion can prove detrimental in that the tensioned hammer spring may weaken over time. It is, therefore, desirable to alleviate the tension upon said hammer spring by pulling the trigger of the weapon and allowing the hammer spring to distend, thus dissipating any pressure exerted thereupon. However, such action results in what is known as "dry-firing", where the firing pin is caused to enter an empty firing chamber of the weapon, thus possibly causing damage to said firing pin.

In avoidance of this dry firing problem and to safely store weapons without tensioned hammer springs, many firearm owners employ what are known as "snap caps". Generally shaped like a shotgun shell or rifle cartridge, these devices are readily slipped into the breach of the weapon, and provide an energy absorbing surface for the firing pin to contact upon relieving the tension in the hammer spring, thus avoiding detrimental dry-firing. Unfortunately, however, these devices must remain within the weapon during storage, since the act of ejecting the device from the weapon would then place the weapon in a ready-to-fire (i.e. tensioned hammer spring) state.

The act of leaving these devices within the weapon presents several distinct problems. In the first place, a weapon having the device contained therein is several steps away from being readied for live ammunition firing. The snap cap must first be ejected from the breach of the weapon, and then a round of live ammunition inserted therein. For a homeowner or businessperson who employs snap caps in the storage of his weapons, the several crucial seconds needed to perform this operation may jeopardize the safety of such person in defensive situations.

A second problem encountered through the use of snap caps is that for individuals or organizations owning and storing large numbers of weapons, a multitude of snap caps must be purchased-one for each weapon. A device is needed which relieves the tension in the hammer spring of a weapon while avoiding dry firing, yet does not need to remain contained within the weapon during storage as do traditional devices.

By way of example, U.S. Pat. No. 3,564,746 to E. E. McConnell issued Feb. 23, 1972, discloses a device for releasing the tension of the main spring of a firearm having a relatively long barrel such as a shotgun or rifle, said device including a rod-shaped member defining a hollow chamber adjacent one end thereof, said member being free from any radially outward projection at the preponderant portion of the length thereof adjacent said hollow chamber to allow insertion of the hollow chamber-defining end of said member into the barrel of a firearm from the muzzle end thereof and movement of said hollow-chamber-defining end to the breech region thereof; and said hollow chamber housing a spring-biased plunger having an axially outer end surface accessible from the outside of said member. In march, the lower end of this device is spherical for rendering the application of forces unequal. in addition, his coil spring is of an extended diameter for creating undesirable drag forces during use.

And, U.S. Pat. No. 5,127,179 issued to Marsh on Jul. 7, 1992, discloses a plurality of extension rods securable relative to one another in a coaxially aligned relationship mounted within a "U" shaped framework arranged for selective securement relative to one another, with the "U" shaped framework mounting a plurality of cleaning tips thereon for ease of usage. A modification of the invention includes an optical viewing device in association with the kit to enhance ease of viewing of various components within an associated firearm. There is no teaching of use with an improved safety device as disclosed herein.

While these traditional units may be suitable for the particular purpose employed, or for general use, they would not be as suitable for the purposes of the present invention as disclosed hereafter.

SUMMARY OF THE INVENTION

The present invention relates to a firearm safety device. More particularly, the invention relates to a muzzle-loaded device which prevents the dry firing of a firearm by absorbing the tension which is stored in the hammer spring of the weapon.

In accordance with the invention, there is provided a muzzle-loaded safety device which removes the tension from a hammer spring of a weapon, thus enabling a weapon owner to readily and safely store his weapon.

In accordance with the invention, there is also provided a muzzle-loaded safety device which, upon removing the tension from a hammer spring of a weapon, may be removed from said weapon, without re-tensioning the hammer spring.

Further in accordance with the invention, there is provided a muzzle-loaded safety device which may be employed consecutively on a plurality of weapons, so that only one such safety device be needed to properly store an entire collection of weapons.

Further in accordance with the invention, there is provided a muzzle-loaded safety device which after relieving the tension in the hammer spring of their weapon, leaves said weapon in a state where it may be readily loaded with live ammunition and fired.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
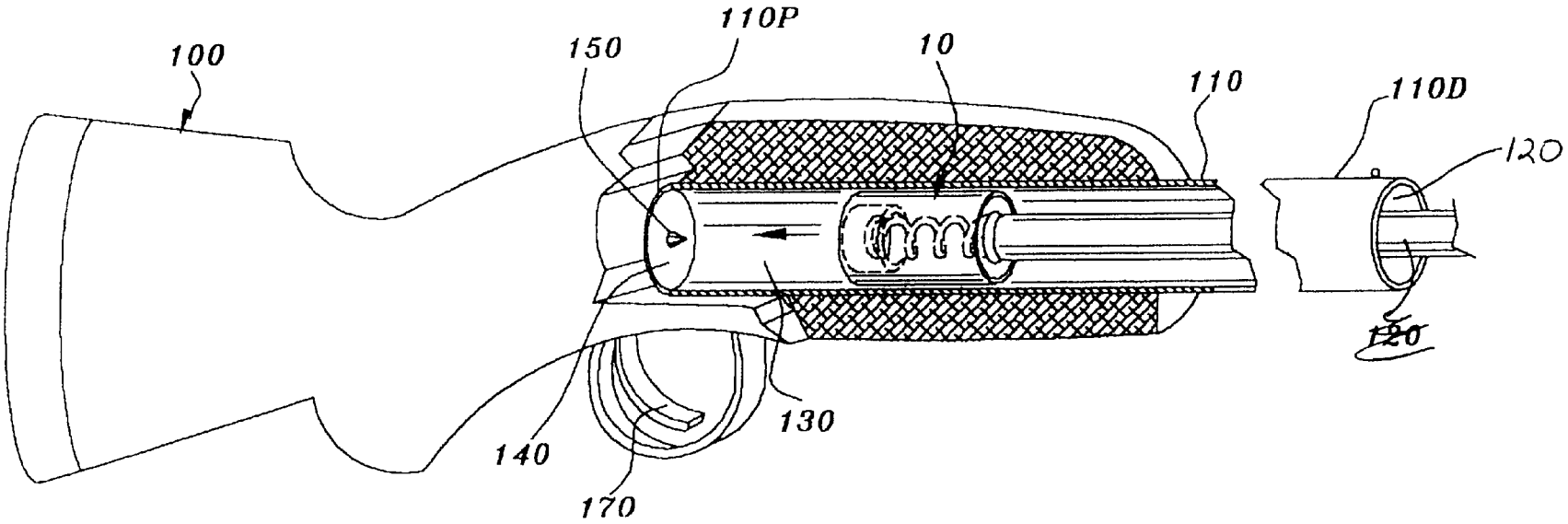
FIG. 1 is a diagrammatic perspective view of the muzzle loaded safety device of the instant invention secured to an end of a cleaning rod and being inserted into the muzzle and down the barrel of a shotgun.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of a muzzle loaded firearm safety device 10. The words "proximal end" and "distal end" refer, respectively, to ends of an object nearer to and further from the operator of the object when the object is used in a normal fashion or as is described in the specification.

FIG. 1 illustrates a typical shotgun 100, the assembly and operation of which will be referred to throughout the ensuing detailed description of the muzzle loaded firearm safety device 10 for a clearer understanding thereof. As can be seen in FIG. 1, the shotgun 100 comprises a barrel 110, cylindrical and hollow in composition which extends throughout the interior of the shotgun 100. The barrel 110 has a barrel proximal end 110P and barrel distal end 110D located opposite therefrom. The distal end 110D of the barrel 100 terminates at an opening, typically referred to as a muzzle 120. An area typically referred to as a firing chamber 130 is located at the proximal end 110P of the barrel. The proximal end 110P of the barrel terminates at, and the firing chamber 130 is defined by, a firing chamber wall 140. A firing pin 150 is shown extending through said firing chamber wall 140.

Figure 2:
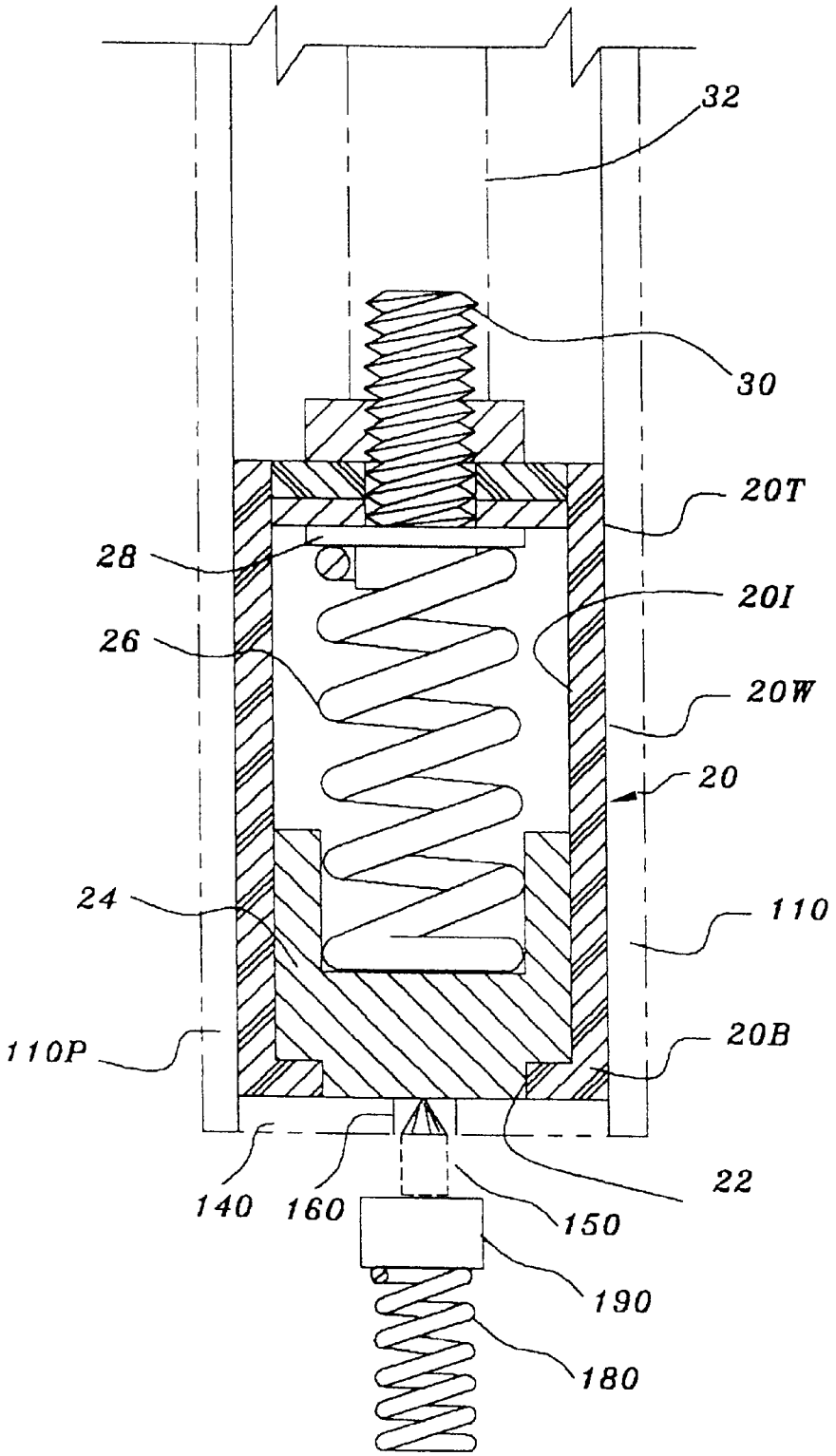
FIG. 2 is a cross sectional view of the muzzle loaded safety device contained within the barrel of the shotgun, with the hammer spring of the shotgun shown in a tensioned state prior to causing the hammer to strike the firing pin.

Reference to FIG. 2 further details the mechanics of the shotgun 100. Shown is the barrel 110 and, more particularly, the barrel proximal end 110P. Also shown is the firing pin 150 and firing pin passageway 160 which extends through the firing chamber wall 140. The firing pin 150 is slidably secured within the firing pin passageway 160. Under normal circumstances, use of the shotgun 100 entails loading a live cartridge (not shown) into the firing chamber 130 via a breech (also not shown). Once contained within the firing chamber 130, the live cartridge rests flush against the firing chamber wall 140.

Figure 3:
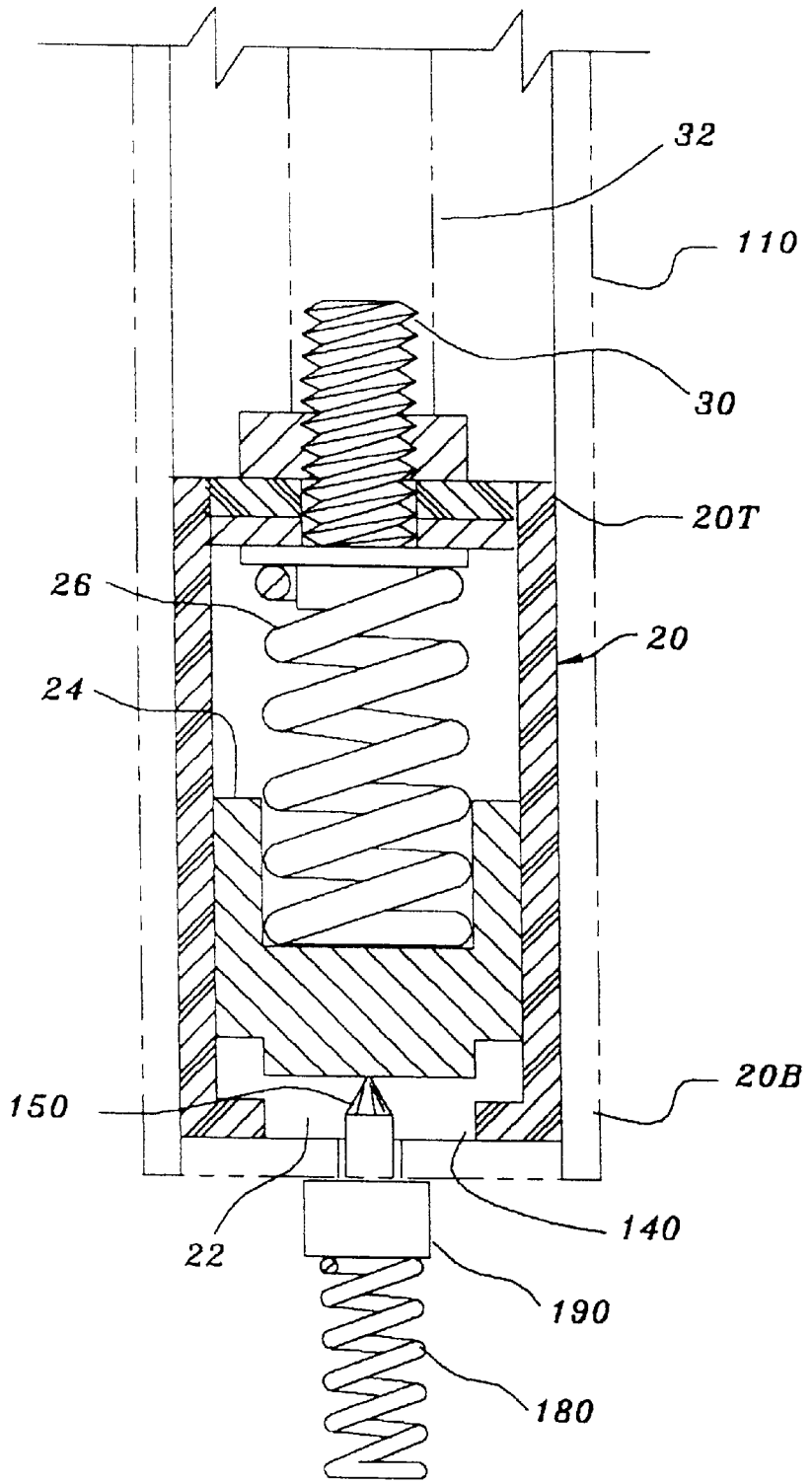
FIG. 3 is a cross sectional view of the muzzle loaded safety device contained within the barrel of the shotgun, with the hammer spring of the shotgun shown in a distended and un-tensioned state subsequent to causing the hammer to strike the firing pin.

Upon a user of the shotgun 100 depressing a trigger 170, a tensioned hammer spring 180 forces a hammer 190 of the shotgun into the firing pin 150. Subsequently, the firing pin 150 is propelled through the firing pin passageway 160 and into the firing chamber 130 where it contacts the live cartridge which is positioned flush against the firing chamber wall 140. As the firing pin 150 contacts the live cartridge, a detonation occurs which propels a segment of the cartridge through the barrel 110 and out of the muzzle 120. Subsequent to this occurrence, the hammer spring 180 is temporarily in a relaxed and un-tensioned state, as seen in FIG. 3. However, in most weapons, the hammer spring 180 is then quickly retracted and re-tensioned (either automatically or as a result of the user manually ejecting the spent cartridge), again left in a ready-to-fire mode. Since it is unwise and detrimental to the weapon to leave the hammer spring 180 in this tensioned stage for prolonged periods (i.e. while storing the shotgun 100), user's often desire to relieve the built-up tension in the hammer spring 180. To simply depress the trigger 170 and allow the hammer 190 to strike the firing pin 150 when there is no cartridge present in the firing chamber 130 (a practice known as "dry firing") can also cause damage to the weapon and is hence inadvisable.

As mentioned earlier, devices known as snap caps are often placed in the firing chamber 130 of the weapon to provide a surface for the firing pin 150 to strike, and thus allow the tension in the hammer spring 180 to be released without dry-firing. However, as also mentioned earlier, these devices must remain within the firing chamber 130 of the weapon during the entire pendency of storage. The muzzle loaded firearm safety device 10 of the instant invention, however, dispenses with that problem.

The muzzle loaded firearm safety device 10 of the instant invention is best illustrated in FIGS. 2 and 3 of the drawings, and comprises a hollow, cylindrical jacket 20 having a jacket inner wall 20I, a jacket outer wall 20W which is parallel to the jacket inner wall 20I, jacket top 20T and jacket bottom 20B. It is contemplated in the preferred embodiment of the instant invention that the jacket 20 be produced in sizes which correspond to typical shotgun cartridge diameter gauges (i.e. 12 gauge, 20 gauge, etc.).

The jacket 20 is completely sealed at the jacket top 20T, but only partially sealed at the jacket bottom 20B. The jacket has a side wall with an internal diameter and an external diameter. It also has an aperture 22 located thereat. The aperture 22 is located in the center of the jacket bottom 20B, concentric to both the inner jacket wall 20I and outer jacket wall 20W, such that it would be adjacent to and aligned with the firing pin passageway 160 if the jacket 20 were contained within the firing chamber 130. The aperture has a cylindrical diameter less than the internal diameter of the side wall.

An impact piston 24 is slidably secured within the hollow cylindrical jacket 20 at the jacket bottom 20B. While the impact piston 24 may consist of any suitable material, it is contemplated in the preferred embodiment of the instant invention that said impact piston 24 consist of a deformable material such as brass. The impact piston is situated within the jacket 20 such that it abuts the aperture 22. The impact piston is formed to have a cylindrical recess extending downwardly from the top thereof with an interior diameter essentially equal to the diameter of the cylindrical extension. Note FIG. 2. The impact piston has a downwardly extending cylindrical extension slidably received within the aperture of the jacket. The bottom of the of the impact piston and the bottom of the jacket are positionable in a common lower plane.

Biasing means, such as a coil spring 26, resiliently bias the impact piston 24 against the jacket bottom 22. The coil spring 26 contemplated by the instant invention extends between the impact piston 24 and a spring abutment 28 located at the jacket top 20T. The coil spring has an upper end and a lower end located within the cylindrical recess of the impact piston.

Also located at the jacket top 20T are securing means, such as a threaded cylinder 30 which is capable of engaging a correspondingly threaded cleaning rod 32. The securing means also includes a downwardly extending cylindrical portion located within the top of the coil spring. By engaging a standard weapon cleaning rod 32 to the thereaded cylinder 30 of the jacket 20, the entire jacket 20 may be inserted into the muzzle 120 of the shotgun 100, as seen clearly in FIG. 1. The jacket 20 may then be forced down the barrel 110 until reaching the firing chamber 130, where the jacket bottom 20B is caused to rest against the firing chamber wall 140, as seen in FIG. 2.

By forcing the jacket 20 squarely against the firing chamber wall 140, the aperture 22 is adjacent to and aligned with the firing pin passageway 160. Since the impact piston 24 is contained within the jacket 20 and abuts the aperture 22, it too is aligned with the firing pin passageway 160 and hence the firing pin 150. By depressing the trigger 170 of the shotgun 100 and allowing the tensioned hammer spring 180 to cause the hammer 190 to strike the firing pin 150, the firing pin 150 will travel through the firing pin passageway 160, and contact the impact piston 24, thus avoiding dry firing. As seen in FIG. 3, as the firing pin 150 contacts the impact piston 24, the impact piston moves upward and absorbs the energy applied thereto by collapsing the coil spring 26. The jacket 20 may then be withdrawn from the barrel 110, with the hammer spring 180 left in an un-tensioned state for storage. Accordingly, the shotgun 100 may be stored without a tensioned hammer spring 180, and also without a device such as the traditional "snap cap" contained within the firing chamber 130. For collectors having large numbers of shotguns 100, the jacket 20 may simply be inserted down the barrel of each weapon, the weapon's trigger 170 pulled to relieve the tension in the hammer spring 180, and the jacket 20 then removed and inserted down the barrel 110 of the next weapon to be stored.

What is claimed is:

1. A muzzle loaded firearm safety device for use in a weapon such as a shotgun equipped with a cylindrically hollow barrel having a muzzle opening at one end and firing chamber defined by a firing chamber wall at the opposite end, a firing pin passageway extending through the firing chamber wall and a firing pin slidably secured within the firing pin passageway, a hammer and a hammer spring biasing said hammer against the firing pin, said device enabling the tension of the hammer spring to be relieved without damage to the firing pin, comprising:

a) a hollow cylindrical jacket with a side wall having an internal diameter and an external diameter and having an enclosed jacket top and terminating at a partially sealed jacket bottom having an aperture with a cylindrical diameter less than the internal diameter of the side wall located thereat, said aperture located in the center of the jacket bottom;

b) an impact piston fabricated of brass slidably secured within the hollow cylindrical jacket at the jacket bottom, the bottom of the impact piston and jacket positionable in a common lower plane, said impact piston having a downwardly extending cylindrical extension of a reduced diameter slidably received within the aperture, the impact piston having a cylindrical recess extending downwardly from the top thereof with an interior diameter essentially equal to the diameter of the cylindrical extension;

c) biasing means comprising a coil spring located between the impact piston and jacket top adapted to bias said impact piston against the aperture at the jacket bottom, the coil spring having an upper end and a lower end located within the cylindrical recess; and d) securing means formed as a threaded cylinder located at the jacket top capable of engaging the threaded end of a standard gun-cleaning rod with a downwardly extending cylindrical projection located within the top of the coil spring, whereby upon engaging said rod to the jacket, the jacket may be inserted into the muzzle and down the barrel of the shotgun until the jacket bottom and aperture located thereat contact the firing chamber wall, the tension in the hammer spring released to drive the hammer into the firing pin thereby driving the firing pin through the aperture at the jacket bottom and into the impact piston which safely absorbs the energy applied thereto without damage to the firing pin, the muzzle loaded firearm safety device then capable of being withdrawn from the barrel and the shotgun stored safely with an un-tensioned hammer spring and empty barrel.

* * * * *